US009150391B2

(12) United States Patent
Wurster et al.

(10) Patent No.: US 9,150,391 B2
(45) Date of Patent: Oct. 6, 2015

(54) HOIST DRIVE FOR MINING MACHINE

(71) Applicant: Harnischfeger Technologies, Inc., Wilmington, DE (US)

(72) Inventors: Andrew M. Wurster, New Berlin, WI (US); Peter Sandoval, Jr., New Berlin, WI (US); Edwin C. Hahlbeck, Pewaukee, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 283 days.

(21) Appl. No.: 13/798,945

(22) Filed: Mar. 13, 2013

(65) Prior Publication Data

US 2013/0259621 A1 Oct. 3, 2013

Related U.S. Application Data

(60) Provisional application No. 61/618,029, filed on Mar. 30, 2012.

(51) Int. Cl.

| | |
|---|---|
| ***B66D 1/22*** | (2006.01) |
| ***E02F 3/30*** | (2006.01) |
| ***E02F 3/42*** | (2006.01) |
| ***E02F 9/20*** | (2006.01) |
| ***E02F 3/46*** | (2006.01) |

(52) U.S. Cl.

CPC . *B66D 1/22* (2013.01); *E02F 3/308* (2013.01); *E02F 3/427* (2013.01); *E02F 3/46* (2013.01); *E02F 9/2016* (2013.01)

(58) Field of Classification Search

CPC .... B66D 1/14; B66D 1/22; E02F 3/03–3/325; E02F 3/427; E02F 3/46–3/60; E02F 9/2016; F16H 1/28; F16H 19/00

See application file for complete search history.

(56) References Cited

U.S. PATENT DOCUMENTS

| | | | |
|---|---|---|---|
| 2,891,767 | A | 6/1959 | Armington, Jr. |
| 3,850,411 | A | 11/1974 | Vavilov et al. |
| 3,885,656 | A | 5/1975 | Michling et al. |
| 4,161,126 | A | 7/1979 | Winzeler |
| 4,227,680 | A | 10/1980 | Hrescak |
| 4,328,954 | A | 5/1982 | Logus |
| 4,408,746 | A | 10/1983 | Marsch et al. |
| 4,856,371 | A | 8/1989 | Kemper |
| 5,141,085 | A | 8/1992 | McCormick |

(Continued)

OTHER PUBLICATIONS

2nd Patent Examination Report from the Intellectual Property Office of Australia for Application No. 2013202500 dated Oct. 31, 2014 (6 pages).

*Primary Examiner* — Jacob S Scott

(74) *Attorney, Agent, or Firm* — Michael Best & Friedrich LLP

(57) ABSTRACT

A hoist system includes a drum, a motor, and a transmission. The drum includes a hollow shell, a first end, a second end, and an internal web, and defines a longitudinal axis extending between the first end and the second end. The internal web extends across an interior portion of the shell in a direction perpendicular to the longitudinal axis, thereby defining a first portion and a second portion of the shell. The motor is coupled to the first end and includes an output shaft. The transmission is driven by the motor and includes a planetary gear train positioned within the interior portion of the shell. The planetary gear train includes an input gear coupled to the motor output shaft and an output gear coupled to the internal web to rotate the drum about the longitudinal axis. The planetary gear train is positioned in a first portion of the shell.

22 Claims, 8 Drawing Sheets

(56) References Cited

U.S. PATENT DOCUMENTS

| | | | | |
|---|---|---|---|---|
| 5,184,807 | A | 2/1993 | Nikolov et al. | |
| 5,860,635 | A * | 1/1999 | Morfitt et al. | 254/377 |
| 2003/0089897 | A1 | 5/2003 | Hodge | |
| 2010/0127229 | A1 | 5/2010 | Kverneland et al. | |
| 2011/0101292 | A1 | 5/2011 | Kempf | |
| 2011/0296721 | A1 | 12/2011 | Ries et al. | |
| 2011/0303886 | A1 | 12/2011 | Cryer et al. | |

* cited by examiner

HOIST DRIVE FOR MINING MACHINE

CROSS-REFERENCE TO RELATED APPLICATIONS

This application claims the benefit of U.S. Provisional Patent Application No. 61/618,029, filed Mar. 30, 2012, the entire contents of which are incorporated herein by reference.

BACKGROUND OF THE INVENTION

The present invention relates to the field of mining machines. Specifically, the present invention relates to a hoist drive for a mining machine such as a rope shovel.

On a conventional mining machine, such as a rope shovel, a mining implement such as a dipper is attached to a handle, and the dipper is supported by a cable, or rope, that passes over a boom sheave. The rope is coupled to the dipper on one end and is wrapped around a hoist drum on the other end. A drive system rotates the hoist drum to reel in or pay out the rope, raising or lowering the dipper, respectively. The drive system typically includes at least one electric motor that is coupled to a speed-reducing gear transmission. The final gear is coupled to the hoist drum to transmit torque to the hoist drum. The drive system is typically large and complicated, and replacing components of the drive system is difficult.

SUMMARY OF THE INVENTION

In one embodiment, the invention provides a hoist system for a mining shovel hoist system for reeling in and paying out a cable. The hoist system includes a drum, a motor, and a transmission. The drum includes a hollow shell, a first end, a second end, and an internal web. The drum defines a longitudinal axis extending between the first end and the second end. The internal web extends across an interior portion of the shell in a direction perpendicular to the longitudinal axis, thereby defining a first portion of the shell and a second portion of the shell. The motor is coupled to the first end and includes an output shaft. The transmission is driven by the motor and includes a planetary gear train positioned within the interior portion of the shell. The planetary gear train includes an input gear coupled to the motor output shaft and an output gear coupled to the internal web to rotate the drum about the longitudinal axis. The planetary gear train is positioned in a first portion of the shell.

In another embodiment, the invention provides an industrial machine including a boom having a boom end, a cable extending over the boom end, a member movably coupled to the boom, and a hoist system for reeling in and paying out the cable in order to move the implement relative to the boom end. The member includes a distal end and an implement coupled to the distal end and coupled to the cable. The hoist system includes a drum, a motor, and a transmission driven by the motor. The drum includes a hollow shell, a first end, a second end, and an internal web, and defines a longitudinal axis extending between the first end and the second end. The internal web extends across an interior portion of the shell in a direction that is perpendicular to the longitudinal axis, thereby defining a first portion of the shell and a second portion of the shell. The motor is coupled to the first end and includes an output shaft. The transmission includes a planetary gear train positioned within the interior portion of the shell. The planetary gear train includes an input gear coupled to the motor output shaft and an output gear coupled to the internal web to rotate the drum about the longitudinal axis, thereby reeling in or paying out the cable. The planetary gear train is positioned in a first portion of the shell.

In yet another embodiment, the invention provides a hoist drive system for reeling in and paying out a cable on a drum. The drum includes a shell having an interior portion, a first end, and a second end, and defines a longitudinal axis extending between the first end and the second end. The hoist drive system includes a motor coupled to the first end, a transmission, a manifold, and a valve. The motor includes a rotatable output shaft. The transmission is driven by the motor output shaft and includes a planetary gear train positioned within the interior portion of the shell. The planetary gear train includes an input gear coupled to the motor output shaft and an output gear to rotate the drum about the longitudinal axis. The manifold is coupled to the motor output shaft and rotates with the motor output shaft. The manifold includes a port and a channel in fluid communication with the port. The channel is in fluid communication with the interior portion of the shell. The valve is in fluid communication with a lubrication medium source and is positioned adjacent the manifold such that the valve is in fluid communication with the port when the port moves past the valve.

In still another embodiment, the invention provides a mining shovel including a boom having a boom end, a cable extending over the boom end, a member movably coupled to the boom, and a hoist system. The member includes a distal end and an implement coupled to the distal end. The implement is coupled to the cable. The hoist system reels in and pays out the cable in order to move the implement relative to the boom end. The hoist system includes a drum, a first motor, a second motor, a first transmission positioned within an interior portion of the drum, and a second transmission positioned within an interior portion of the drum. The drum includes a first end and a second end and defines a longitudinal axis extending therebetween. The first motor is positioned proximate the first end of the drum and includes a first output shaft. The second motor is positioned proximate the second end of the drum and includes a second output shaft. The first transmission includes a first input gear coupled to the first motor output shaft and a first output gear coupled to the drum to rotate the drum about the longitudinal axis. The second transmission includes a second input gear coupled to the second motor output shaft and a second output gear coupled to the drum to rotate the drum about the longitudinal axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
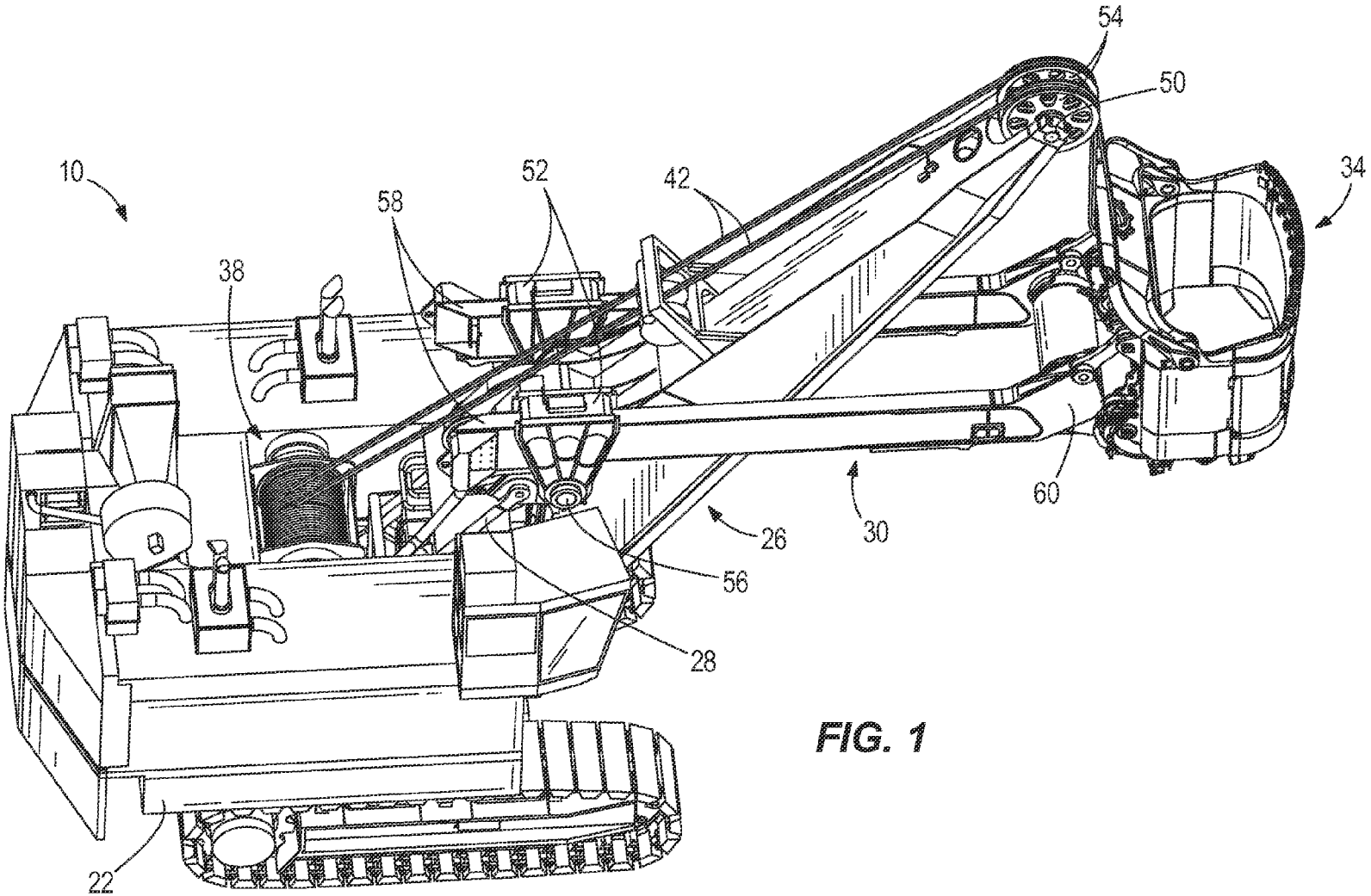
FIG. 1 is a perspective view of a mining shovel.

As shown in FIG. 1, an industrial machine, such as a mining shovel 10, rests on a support surface or floor, and includes a base 22, a boom 26, a support member 28 extending between the base 22 and the boom 26, an elongated member or handle 30, and a work implement or dipper 34. The base 22 includes a hoist system 38 for reeling in and paying out a cable or hoist rope 42. The boom 26 includes a first end (not shown) coupled to the base 22, a second end 50 opposite the first end, saddle blocks 52, a boom sheave 54 coupled to the second end 50, and a shipper shaft 56. The boom 26 is pivotable relative to the base 22 about the first end. In the illustrated embodiment, the support member 28 limits the pivoting movement of the boom 26 relative to the base 22. In other embodiments, the boom 26 is supported by a gantry or similar structure.

The handle 30 is movably coupled to the boom 26 and includes a first end 58 and a second end 60. The first end 58 is moveably received in the saddle blocks 52, and the handle 30 passes through the saddle block 52 such that the handle 30 is configured for rotational and translational movement relative to the boom 26. Stated another way, the handle 30 is linearly extendable relative to the saddle block 52 and is rotatable about the shipper shaft 56.

The rope 42 is secured to the hoist system 38, passes over the boom sheave 54, and is coupled to the dipper 34. The dipper 34 is raised or lowered relative to the boom sheave 54 as the rope 42 is reeled in or paid out, respectively, by the hoist system 38. In the illustrated embodiment, the dipper 34 is fixed relative to the handle 30. In other embodiments, the machine 10 includes a bucket that is pivotable relative to the handle 30 about the second end 60.

Figure 2:
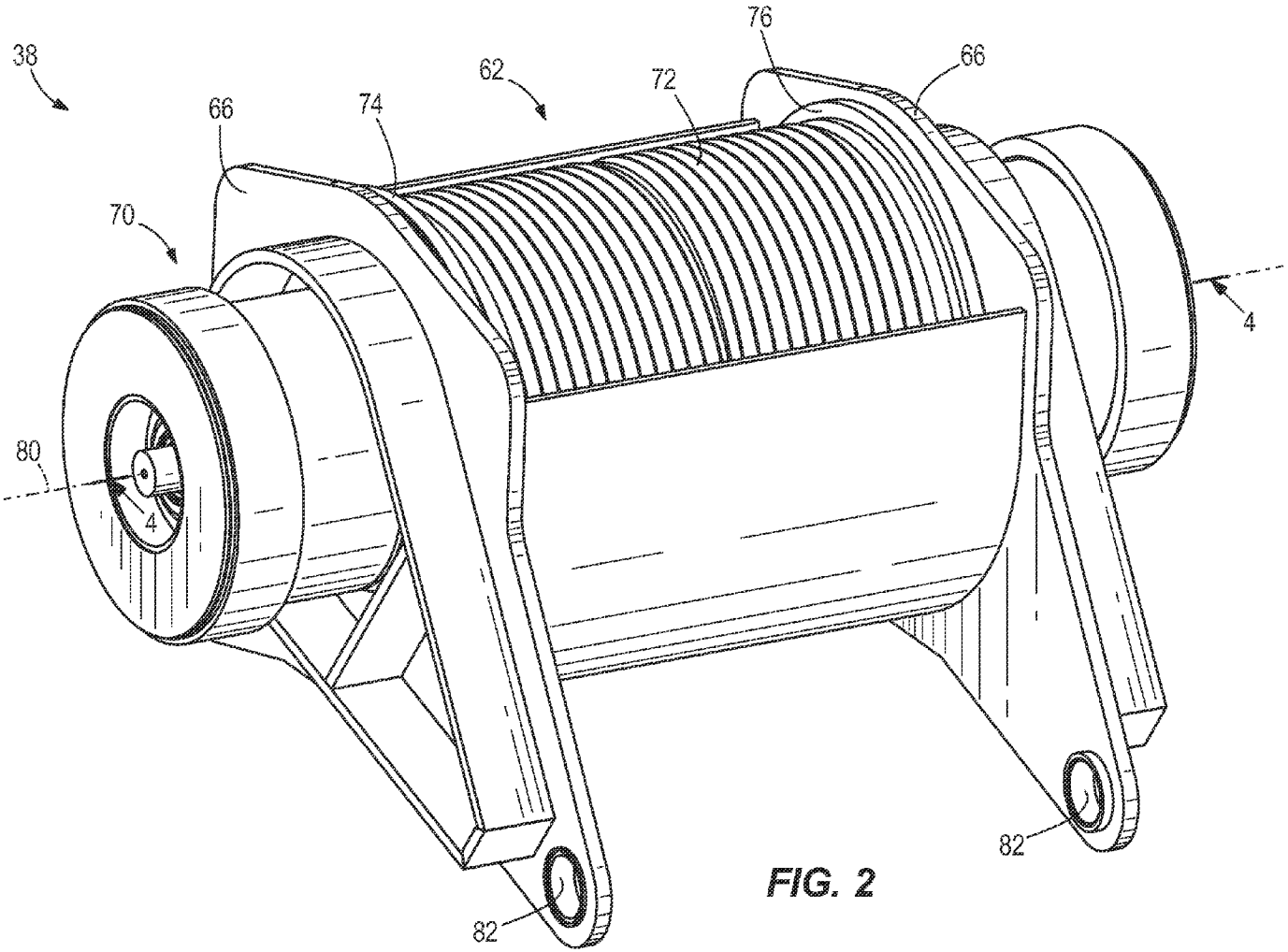
FIG. 2 is a perspective view of a hoist system according to one embodiment of the invention.
Figure 4:
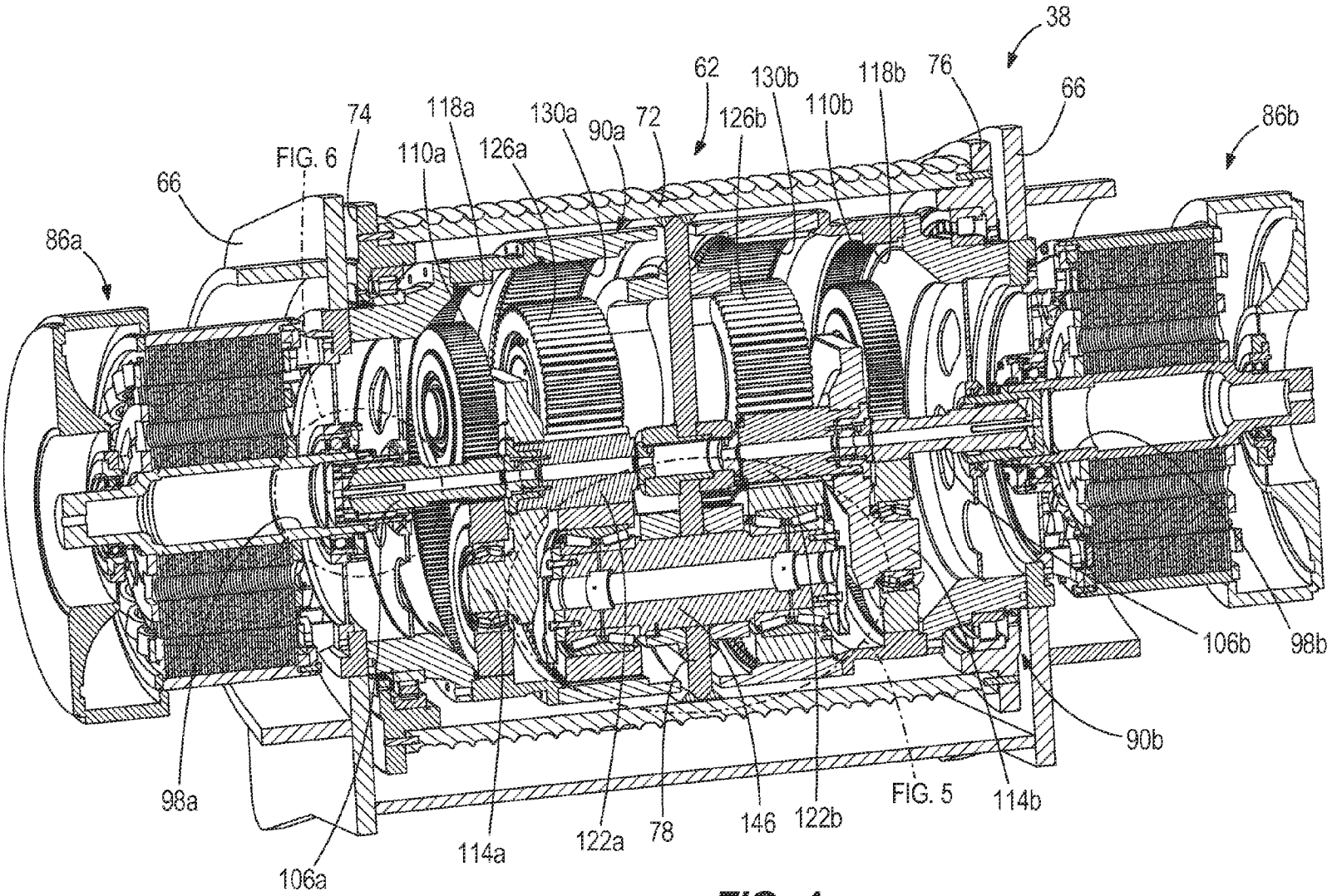
FIG. 4 is a section view of the hoist system of FIG. 2, taken along line 4-4.

As shown in FIG. 2, the hoist system 38 includes a drum 62, a pair of mounting brackets 66 supporting the drum 62, and a drive system 70. The drum 62 includes a shell or reel portion 72 for receiving the hoist rope 42, a first end 74, a second end 76, and an internal web 78 (FIG. 4). The drum 62 defines a longitudinal axis 80 extending from the first end 74 to the second end 76. In the embodiment shown in FIG. 2, the mounting brackets 66 rotatably support the drum ends 74, 76 and include a pair of lugs 82. A pin (not shown) is inserted through each lug 82 to couple the hoist system 38 to the base 22 of the shovel 10. When the pins are removed, the hoist system 38 can be removed from the shovel 10, permitting the entire hoist system 38 to be replaced.

Figure 3:
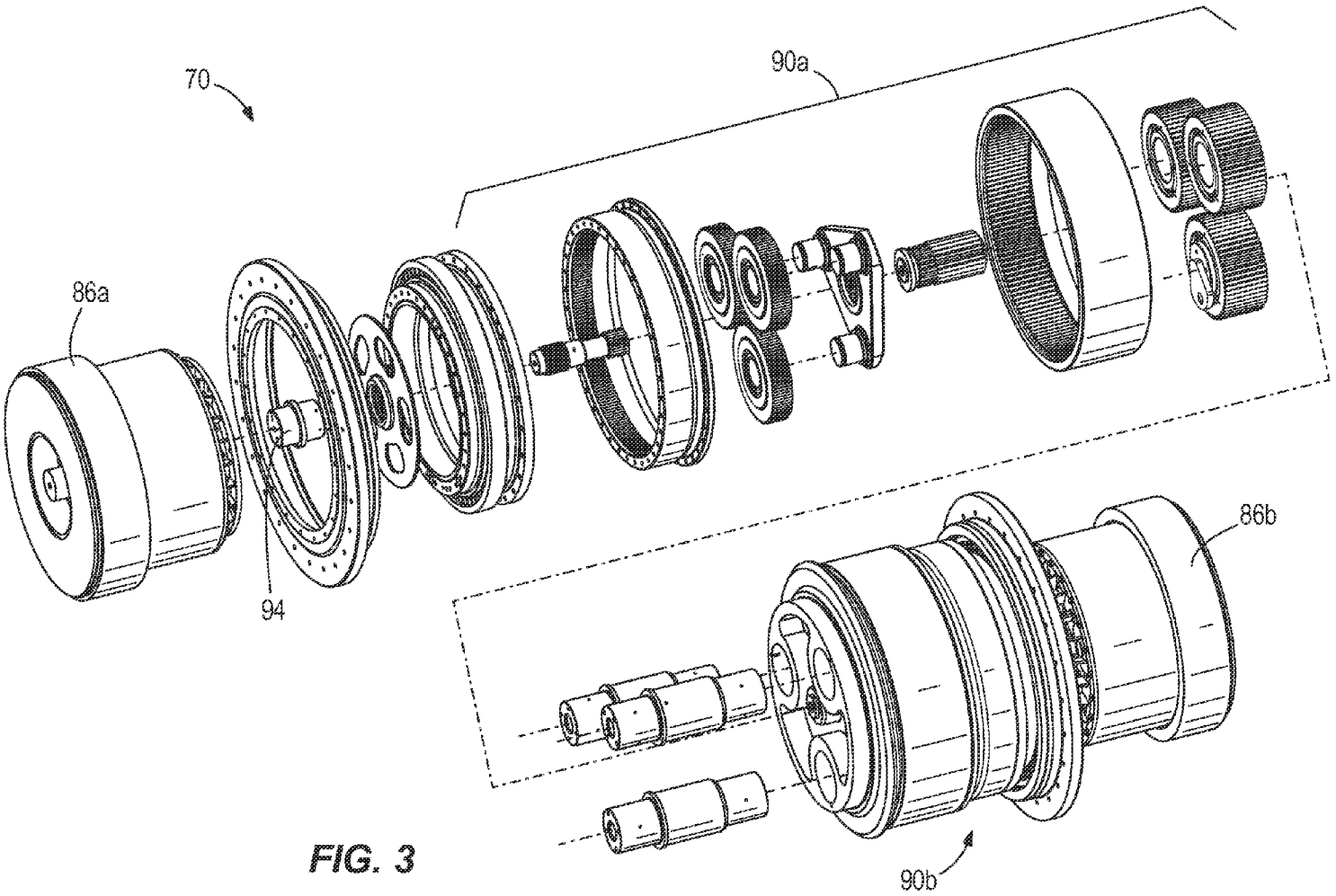
FIG. 3 is a partial exploded view of the hoist system of FIG. 2 with a drum removed.
Figure 6:
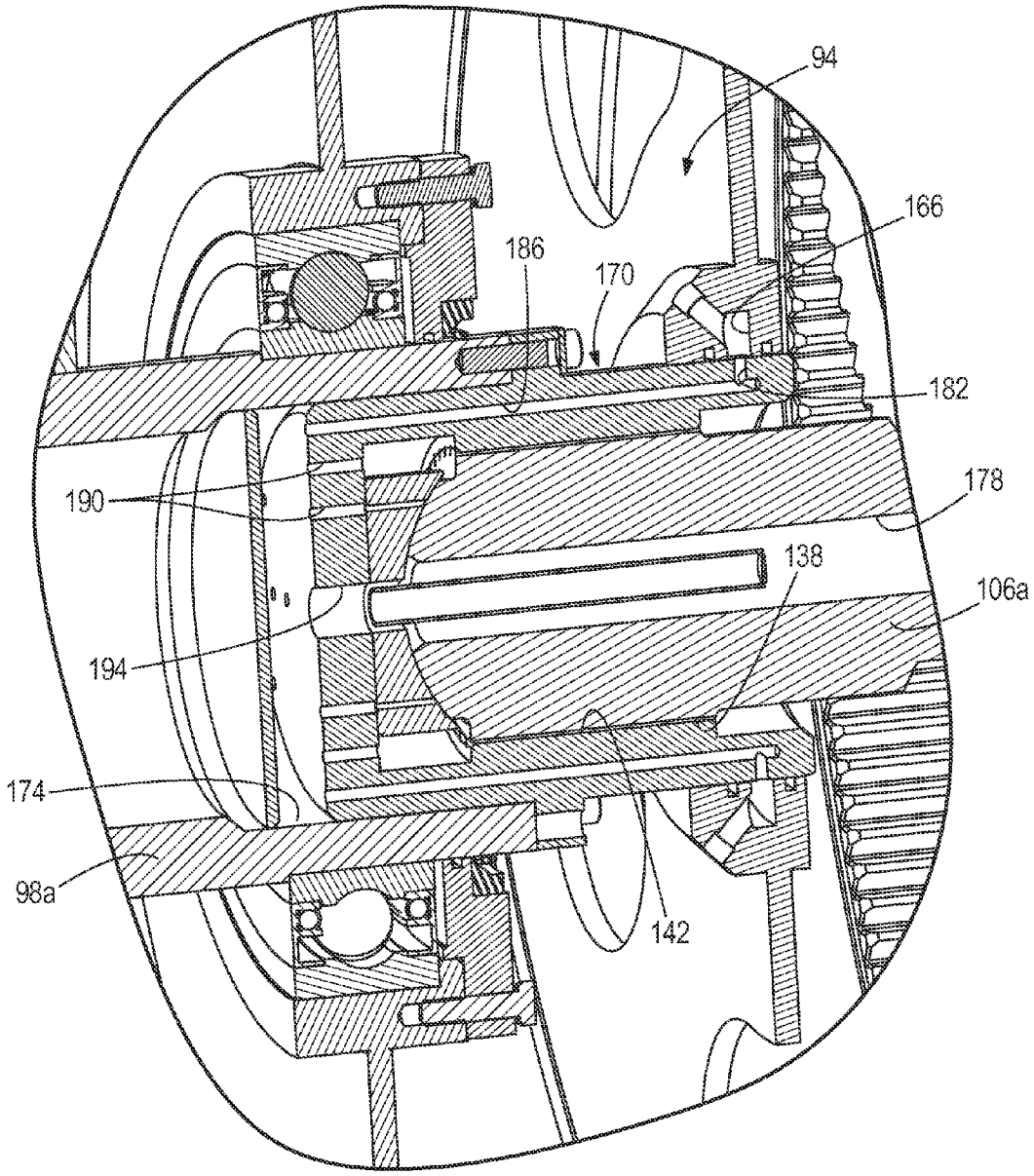
FIG. 6 is an enlarged section view of the hoist system of FIG. 4.

As shown in FIGS. 3 and 4, the drive system 70 includes a first motor 86*a*, a second motor 86*b*, a first transmission 90*a* positioned within the drum 62, a second transmission 90*b* positioned within the drum 62, and a lubrication system 94 (FIG. 6). Since the first motor 86*a* is substantially identical to the second motor 86*b* and the first transmission 90*a* is substantially identical to the second transmission 90*b*, for brevity only one component will be described in detail. In the illustrated embodiment the first motor 86*a* is electric, and may be any type of electric motor, including alternating current (AC), direct current (DC), or switched reluctance (SR). The first motor 86*a* is supported by one of the mounting brackets 66 and includes an output shaft 98*a* (FIG. 4).

In the illustrated embodiment, the first transmission 90*a* is a planetary gear train. The first transmission 90*a* includes an input pinion 106*a* coupled to the motor output shaft 98*a*, multiple first planet gears 110*a* coupled to a first carrier 114*a*, a first ring gear 118*a*, a sun gear 122*a*, multiple second planet gears 126*a*, and a second ring gear 130*a*. The second planet gears 126*a* are coupled to the web 78. In the illustrated embodiment, the input pinion 106*a* includes an external spline 138 (FIG. 6) that engages an internal spline 142 (FIG. 6) coupled to the motor output shaft 98*a*. Also, in the illustrated embodiment, the first transmission 90*a* includes three first planet gears 110*a* and three second planet gears 126*a*, although each set of planet gears 110*a*, 126*a* may include fewer or more planet gears. Furthermore, in the illustrated embodiment, the first ring gear 118*a* and second ring gear 130*a* are coupled to the mounting bracket 66 (FIG. 4) and do not rotate about the longitudinal axis 80.

Figure 5:
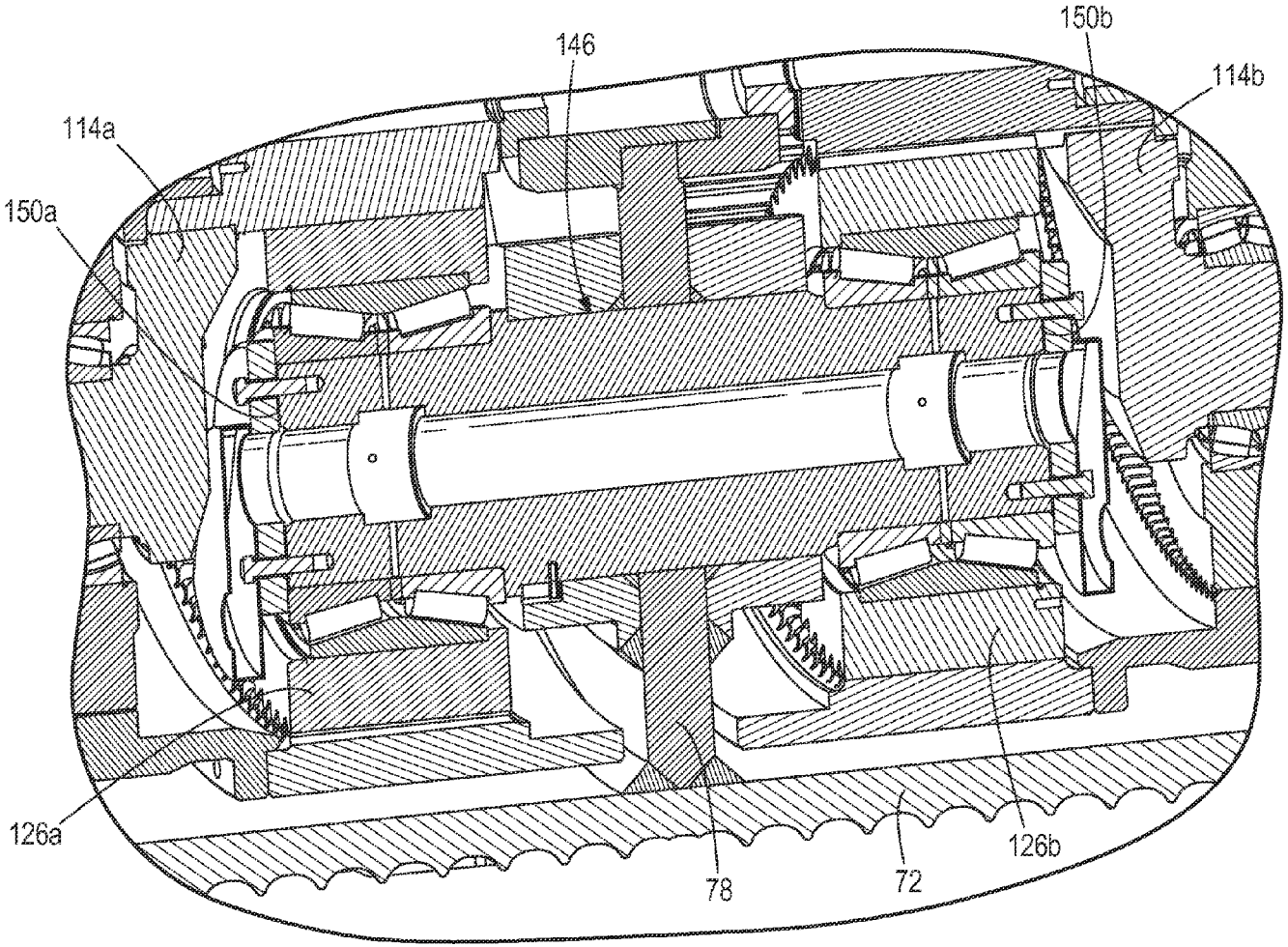
FIG. 5 is an enlarged section view of the hoist system of FIG. 4.

Referring to FIGS. 4 and 5, the internal web 78 extends across an interior portion of the drum 62 in a direction that is perpendicular to the longitudinal axis 80, thereby dividing an interior portion of the drum 62 into a first portion housing the first transmission 90*a* and a second portion housing the second transmission 90*b*. The web 78 includes planet pins 146, and each pin 146 extends through the web 78 so that a first end 150*a* (FIG. 5) of the pin 146 is proximate the first transmission 90*a* and a second end 150*b* (FIG. 5) is proximate the second transmission 90*b*. The second planet gears 126*a*, 126*b* are rotatably coupled to the planet pins 146. More specifically, each second planet gear 126*a* of the first transmission 90*a* is coupled to the first end 150*a* of one of the pins 146, and a corresponding second planet gear 126*b* of the second transmission 90*b* is coupled to the second end 150*b* of the same planet pin 146.

Coupling the second planet gears 126*a*, 126*b* to a common pin 146 on either side of the web 78 provides a double-supported condition on the pins 146, reducing the bending moment on the web 78 that would otherwise occur if the pins 146 were cantilevered. As a result, the pins 146 and the web 78 are primarily subjected to only shear loads. This configuration balances the load on the pin 146 and the web 78 by reducing the reaction bending moments that otherwise would arise due to the gear forces. The reduced moment permits a reduction of the web's thickness without loss of strength, and therefore reduces the weight of the drum 62. In addition, the balanced condition reduces deflection and misalignment of the gears during operation.

During operation, the motor output shaft 98*a* rotates the input pinion 106*a*, causing rotation of the first planet gears 110*a*. As the first planet gears 110*a* rotate, the first planet gears 110*a* revolve around the input pinion 106*a*, causing rotation of the first carrier 114*a*. The rotation of the first carrier 114*a* drives the sun gear 122*a*, which in turn rotates the second planet gears 126*a*. As the second planet gears 126*a* rotate, the second planet gears 126*a* revolve around the sun gear 122*a*. The revolution of the second planet gears 126*a* exerts a rotational force on the planet pins 146 and the web 78, thereby cause the drum 62 to rotate in a desired direction to either reel in or pay out the hoist rope 42. Simultaneously, the motor output shaft 98*b* rotates the input pinion 106*b* in a direction opposite the rotation of the input pinion 106*a* in order to exert a similar rotational force on the planet pins 146 via second planet gears 126*b*. In one embodiment, the gear ratio between each motor output shaft 98*a*, 98*b* and the drum 62 is approximately 70:1.

FIG. 6 illustrates the lubrication system associated with the first motor 86*a* and the first transmission 90*a*. For brevity, the lubrication system associated with the second motor 86*b* and the second transmission 90*b* is substantially identical to the lubrication system 94 and therefore is not described in detail. The lubrication circuit 94 includes a valve 166, a rotating manifold 170 coupled to the motor output shaft 98*a*, a sealed chamber 174 within the motor output shaft 98*a*, and a transmission channel 178. The valve 166 receives a lubrication medium, such as grease, from a supply conduit (not shown) that is in fluid communication with a fluid pump (not shown). In some embodiments, the supply conduit is a hose.

The valve 166 is positioned adjacent to the rotating manifold 170. The manifold 170 includes at least one port 182, a first channel 186, a second channel 190, and a third channel 194. Each port 182 is positioned such that the port 182 is aligned with the valve 166 periodically. In the illustrated embodiment, the rotating manifold 170 is separated from the valve 166 by a small clearance such that the manifold 170 and the valve 166 do not contact. The first channel 186 is in fluid communication between the port 182 and the sealed chamber 174. The second channel 190 is in fluid communication between the sealed chamber 174 and the internal spline 142 of the motor output shaft 98*a*. The third channel 194 is schematically parallel to the second channel 190 and is in fluid communication between the sealed chamber 174 and the transmission channel 178. As shown in FIG. 4, the transmission channel 178 extends through the pinion input 106*a* and is in fluid communication with the areas adjacent to the other gears of the transmission 90*a*.

During operation, the motor output shaft 98*a* drives the rotating manifold 170. During each rotation of the manifold 170, the port 182 is placed in communication with the valve 166 at least once, allowing fluid to enter the first channel 186. The fluid is pumped through the first channel 186 to the sealed chamber 174. From the sealed chamber 174, the fluid either enters the second channel 190 or the third channel 194. Fluid flowing through the second channel 190 provides lubrication to the connection between the internal spline 142 of the rotating manifold 170 and the external spline 138 of the input pinion 106*a*. Fluid flowing through the third channel 194, on the other hand, enters the transmission channel 178 and provides lubrication to the other connections in the transmission 90, including thrust plugs or other connections between the gears 110, 126 and the carriers 114, 134.

Positioning the transmissions 90*a*, 90*b* within the drum 62 provides a compact hoist system 38 with a self-contained drive system that occupies less space and weighs less than prior art hoist systems. This reduces the amount of time required to service or replace the hoist system 38. Furthermore, the common pin mounting for the second gear drive of each transmission 90*a*, 90*b* balances bending loads on the components of hoist system 38. In addition, the lubrication circuit 94 provides better lubrication for the rotating components, reducing the amount of wear on the components of the drive system 70.

Figure 7:
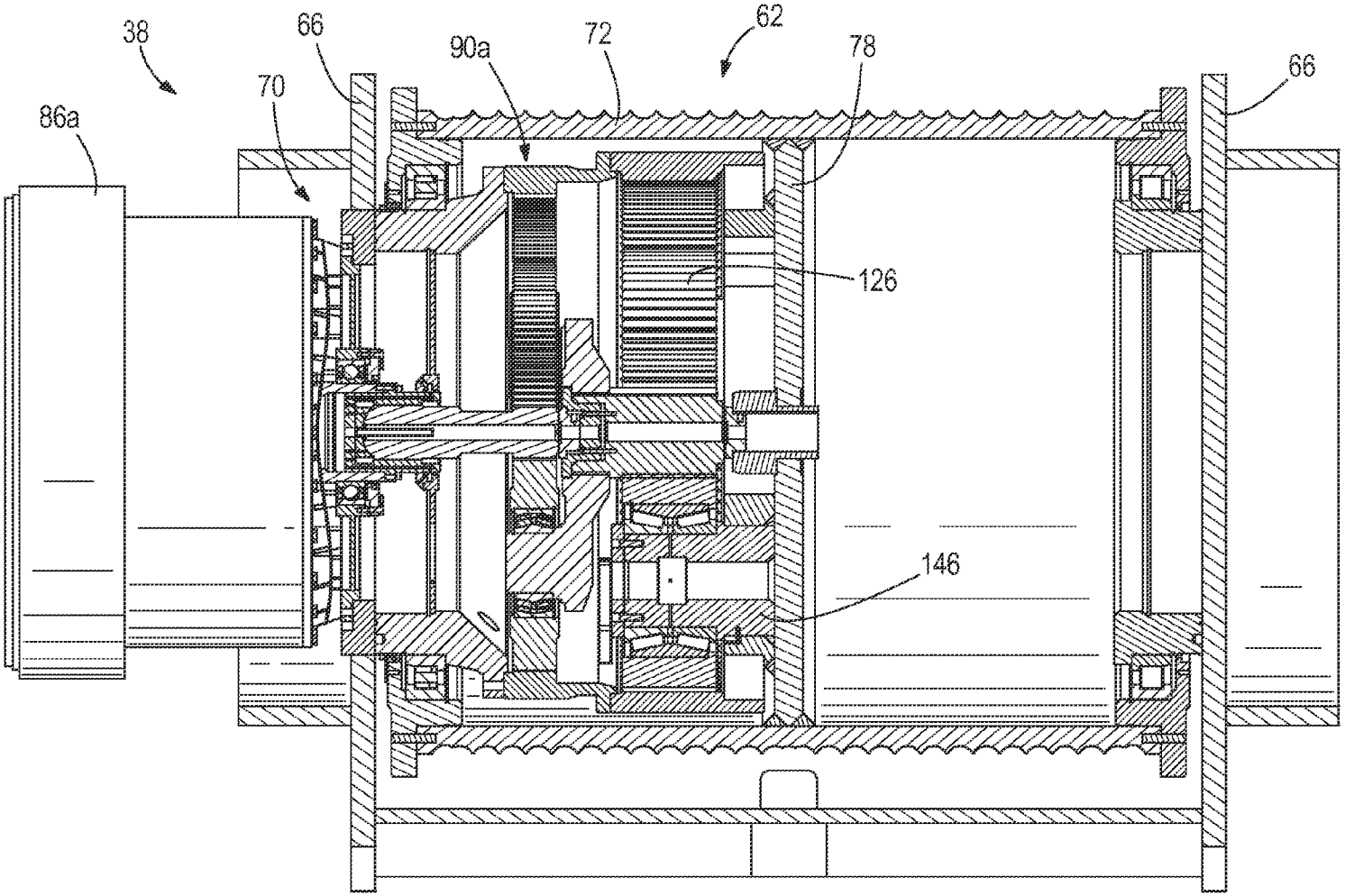
FIG. 7 is a section view of a hoist system according to another embodiment.
Figure 8:
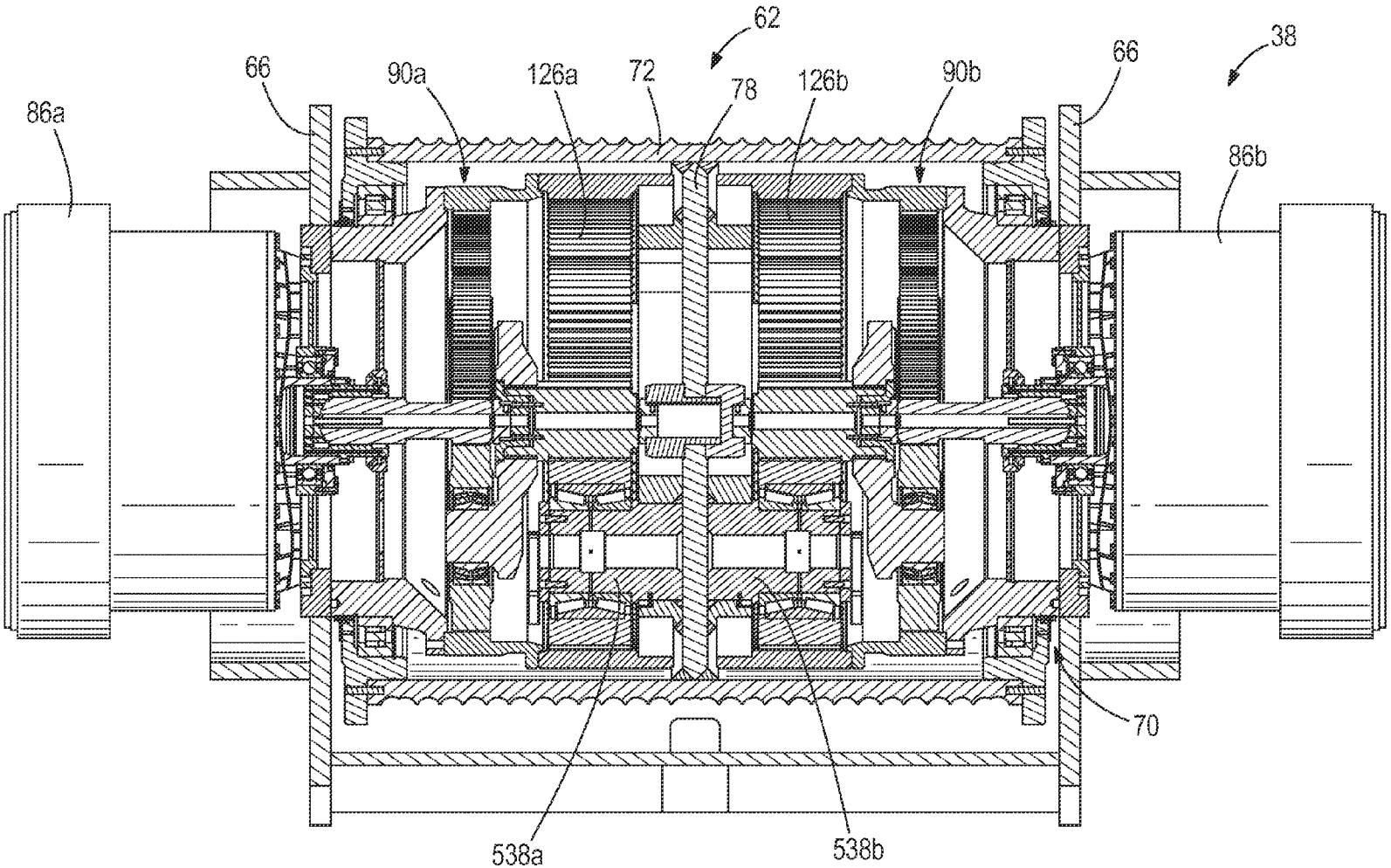
FIG. 8 is a section view of a hoist system according to another embodiment.

As shown in FIG. 7, in another embodiment the drive system 70 may include only the first motor 86*a* and first transmission 90*a* coupled to the first motor 90*a* to transmit power to the drum 62. In this embodiment, the second planet gears 126*a* are coupled to planet pins 146 that only extend into the first interior portion of the drum 62. In another embodiment, shown in FIG. 8, pins 538 do not extend through the web 78, but are split between each side of the web 78. The second planet gears 126*a*, 126*b* are rotatably coupled to the pins 538*a*, 538*b*, respectively, that are coupled to opposite sides of the web 78. Corresponding pins 538*a*, 538*b* are aligned with one another along a common axis.

Thus, the invention provides, among other things, a hoist system for an industrial machine. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A hoist system for reeling in and paying out a cable, the hoist system comprising:

a drum including a hollow shell, a first end, a second end, and an internal web, the drum defining a longitudinal axis extending between the first end and the second end, the internal web extending across an interior portion of the shell in a direction that is perpendicular to the longitudinal axis, thereby defining a first portion of the shell and a second portion of the shell;

a motor positioned proximate the first end of the drum, the motor including an output shaft;

a first transmission driven by the motor, the transmission including a first planetary gear train positioned within the interior portion of the shell, the first planetary gear train including an input gear coupled to the motor output shaft and a first output gear coupled to the internal web to rotate the drum about the longitudinal axis, the first planetary gear train being positioned in the first portion of the shell; and a second transmission including a second planetary gear train positioned within the interior portion of the shell, the second planetary gear train including a second output gear coupled to the internal web to rotate the drum about the longitudinal axis, the second planetary gear train being positioned in the second portion of the shell.

2. The hoist system of claim 1, wherein the first planetary gear train includes a first planetary gear drive and a second planetary gear drive, the first planetary gear drive including a plurality of first planet gears, a carrier supporting the plurality of first planet gears, a sun gear coupled to the carrier, and the first output gear is a plurality of second planet gears, wherein rotation of the first input gear causes rotation and revolution of the plurality of first planet gears, the revolution of the plurality of first planet gears causing the carrier to rotate and thereby rotate the sun gear, the rotation of the sun gear causing rotation and revolution of the plurality of second planet gears, the revolution of the second planet gears causing the drum to rotate.

3. The hoist system of claim 2, further comprising a plurality of planet pins coupled to the internal web, wherein each second planet gear is coupled to one of the planet pins.

4. The hoist system of claim 1, wherein the motor is a first motor and the output shaft is a first output shaft, the input gear of the first planetary gear train is a first input gear, the hoist system further comprising a second motor positioned proximate the second end of the drum, the second motor including a second output shaft, wherein the second planetary gear train includes a second input gear coupled to the second output shaft.

5. The hoist system of claim 1, further comprising a planet pin coupled to the internal web, the planet pin including a first end positioned in the first portion of the shell and a second end positioned in the second portion of the shell, wherein the first output gear is coupled to the first end of the planet pin and the second output gear coupled to the second end of the planet pin.

6. The hoist system of claim 1, further comprising a manifold coupled to the output shaft of the motor and a valve positioned adjacent the manifold, the valve being in fluid communication with a lubrication medium source, the manifold having a port and a first channel in fluid communication with the port, the port positioned such that the port is in fluid communication with the valve at a predetermined interval, the first channel being in fluid communication with the first portion of the shell to transport the lubrication medium to the planetary gear train.

7. The hoist system of claim 6, wherein the manifold further includes a second channel in fluid communication with a coupling between the motor output shaft and the input gear of the first planetary gear train.

8. The hoist system of claim 6, wherein rotation of the motor output shaft causes the manifold to rotate such that the port is positioned near the valve periodically to receive lubrication medium from the valve.

9. An industrial machine comprising:

a boom including a boom end;

a cable extending over the boom end;

a member movably coupled to the boom, the member including a distal end and an implement coupled to the distal end, the implement being coupled to the cable; and a hoist system for reeling in and paying out the cable in order to move the implement relative to the boom end, the hoist system including a drum including a hollow shell, a first end, a second end, and an internal web, the drum defining a longitudinal axis extending between the first end and the second end, the internal web extending across an interior portion of the shell in a direction that is perpendicular to the longitudinal axis, thereby defining a first portion of the shell and a second portion of the shell;

a motor positioned proximate the first end of the drum, the motor including an output shaft;

a first transmission driven by the motor, the transmission including a first planetary gear train positioned within the interior portion of the shell, the first planetary gear train including an input gear coupled to the motor output shaft and a first output gear coupled to the internal web to rotate the drum about the longitudinal axis thereby reeling in or paying out the cable, the first planetary gear train being positioned in the first portion of the shell; and a second transmission including a second planetary gear train positioned within the interior portion of the shell, the second planetary gear train including a second output gear coupled to the internal web to rotate the drum about the longitudinal axis, the second planetary gear train being positioned in the second portion of the shell.

10. The industrial machine of claim 9, wherein the first planetary gear train includes a first planetary gear drive and a second planetary gear drive, the first planetary gear drive including a plurality of first planet gears, a carrier supporting the plurality of first planet gears, a sun gear coupled to the carrier, and the first output gear is a plurality of second planet gears, wherein rotation of the first input gear causes rotation and revolution of the plurality of first planet gears, the revolution of the plurality of first planet gears causing the carrier to rotate and thereby rotate the sun gear, the rotation of the sun gear causing rotation and revolution of the plurality of second planet gears, the revolution of the second planet gears causing the drum to rotate.

11. The industrial machine of claim 10, further comprising a plurality of planet pins coupled to the internal web, wherein each second planet gear is coupled to one of the planet pins.

12. The industrial machine of claim 9, wherein the motor is a first motor and the output shaft is a first output shaft, the input gear of the first planetary gear train is a first input gear, the hoist system further comprising a second motor positioned proximate the second end of the drum, the second motor including a second output shaft, wherein the second planetary gear train includes a second input gear coupled to the second output shaft.

13. The industrial machine of claim 9, further comprising a planet pin coupled to the internal web, the planet pin including a first end positioned in the first portion of the shell and a second end positioned in the second portion of the shell, wherein the first output gear is coupled to the first end of the planet pin and the second output gear coupled to the second end of the planet pin.

14. The industrial machine of claim 9, further comprising a manifold coupled to the output shaft of the motor and a valve positioned adjacent the manifold, the valve being in fluid communication with a lubrication medium source, the manifold having a port and a first channel in fluid communication with the port, the port positioned such that the port is in fluid communication with the valve at a predetermined interval, the first channel being in fluid communication with the first portion of the shell to transport the lubrication medium to the planetary gear train.

15. The industrial machine of claim 14, wherein the manifold further includes a second channel in fluid communication with a coupling between the motor output shaft and the input gear of the first planetary gear train.

16. The industrial machine of claim 14, wherein rotation of the motor output shaft causes the manifold to rotate such that the port is positioned near the valve periodically to receive lubrication medium from the valve.

17. A hoist drive system for reeling in and paying out a cable on a drum, the drum including a shell having an interior portion, a first end, a second end, the drum defining a longitudinal axis extending between the first end and the second end, the hoist drive system comprising:

a motor positioned proximate the first end of the drum, the motor including a rotatable output shaft;

a transmission driven by the motor output shaft, the transmission including a planetary gear train positioned within the interior portion of the shell, the planetary gear train including an input gear coupled to the motor output shaft and an output gear to rotate the drum about the longitudinal axis;

a manifold coupled to the motor output shaft and rotating with the motor output shaft, the manifold including a port and a channel in fluid communication with the port, the channel being in fluid communication with the interior portion of the shell; and a valve in fluid communication with a lubrication medium source, the valve positioned adjacent the manifold such that the valve is in fluid communication with the port when the port moves past the valve.

18. The hoist drive system of claim 17, wherein the channel of the manifold is a first channel, and the manifold further includes a second channel in fluid communication with a coupling between the motor output shaft and the input gear of the planetary gear train.

19. A mining shovel comprising:

a boom including a boom end;

a cable extending over the boom end;

a member movably coupled to the boom, the member including a distal end and an implement coupled to the distal end, the implement being coupled to the cable; and a hoist system for reeling in and paying out the cable in order to move the implement relative to the boom end, the hoist system including drum including a first end and a second end and defining a longitudinal axis extending therebetween;

a first motor positioned proximate the first end of the drum, the first motor including a first output shaft;

a second motor positioned proximate the second end of the drum, the second motor including a second output shaft;

a first transmission positioned within an interior portion of the drum, the first transmission including a first input gear coupled to the first motor output shaft and a first output gear coupled to the drum to rotate the drum about the longitudinal axis; and a second transmission positioned within the interior portion of the drum, the second transmission including a second input gear coupled to the second motor output shaft and a second output gear coupled to the drum to rotate the drum about the longitudinal axis.

20. The mining shovel of claim 19, further comprising a pin coupled to an internal drum wall, the first output gear and the second output gear being coupled to the pin to rotate the drum.

21. The mining shovel of claim 20, wherein the first output gear is a plurality of first planet gears, each first planet gear being rotatably coupled to one of a plurality of planet pins and revolving around the longitudinal axis to rotate the drum, wherein the second output gear is a plurality of second planet gears, each second planet gear being rotatably coupled to one of the plurality of planet pins and revolving around the longitudinal axis to rotate the drum.

22. The mining shovel of claim 20, wherein the first transmission includes a plurality of first planet gears, a first carrier supporting the plurality of first planet gears, a first sun gear coupled to the first carrier, and the first output gear, the first output gear being a plurality of second planet gears, wherein the second transmission includes a plurality of third planet gears, a second carrier supporting the plurality of third planet gears, a second sun gear coupled to the second carrier, and the second output gear, the second output gear being a plurality of fourth planet gears, wherein rotation of the first input gear causes revolution of the plurality of second planet gears about the longitudinal axis, the revolution of the second planet gears driving the drum to rotate, wherein rotation of the second input gear causes revolution of the plurality of fourth planet gears about the longitudinal axis, the revolution of the fourth planet gears driving the drum to rotate.

* * * * *